US010147365B2

(12) United States Patent
Jeon

(10) Patent No.: US 10,147,365 B2
(45) Date of Patent: Dec. 4, 2018

(54) LIQUID CRYSTAL DISPLAY DEVICE AND METHOD OF PERFORMING LOCAL DIMMING OF THE SAME

(71) Applicant: LG DISPLAY CO., LTD., Seoul (KR)

(72) Inventor: Homin Jeon, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 49 days.

(21) Appl. No.: 15/378,896

(22) Filed: Dec. 14, 2016

(65) Prior Publication Data

US 2018/0061330 A1 Mar. 1, 2018

(30) Foreign Application Priority Data

Aug. 30, 2016 (KR) ..... 10-2016-0110941

(51) Int. Cl.

| | |
|---|---|
| ***G09G 3/34*** | (2006.01) |
| ***G09G 3/20*** | (2006.01) |
| ***G09G 3/36*** | (2006.01) |

(52) U.S. Cl.

CPC ..... *G09G 3/342* (2013.01); *G09G 3/2007* (2013.01); *G09G 3/3413* (2013.01); *G09G 3/3426* (2013.01); *G09G 3/3648* (2013.01); *G09G 3/3677* (2013.01); *G09G 3/3688* (2013.01); *G09G 2310/08* (2013.01); *G09G 2320/029* (2013.01); *G09G 2320/0233* (2013.01); *G09G 2320/0238* (2013.01); *G09G 2320/0626* (2013.01); *G09G 2320/0646* (2013.01); *G09G 2320/0686* (2013.01); *G09G 2320/0693* (2013.01); *G09G 2320/08* (2013.01); *G09G 2360/145* (2013.01); *G09G 2360/16* (2013.01)

(58) Field of Classification Search

CPC ..... G09G 3/342; G09G 2320/0646; G09G 2320/0238; G09G 2320/0233

See application file for complete search history.

(56) References Cited

U.S. PATENT DOCUMENTS

| | | | |
|---|---|---|---|
| 2008/0309611 | A1 | 12/2008 | Yang |
| 2009/0040423 | A1 | 2/2009 | Bae et al. |
| 2010/0060555 | A1 | 3/2010 | Lee et al. |
| 2011/0012943 | A1 | 1/2011 | Tsai |

FOREIGN PATENT DOCUMENTS

| | | | |
|---|---|---|---|
| JP | 2015-4843 | A | 1/2015 |
| KR | 10-2011-0067352 | A | 6/2011 |
| TW | 201044074 | A1 | 12/2010 |
| TW | I398846 | B | 6/2013 |
| TW | 201617705 | A | 5/2016 |

*Primary Examiner* — Laurence J Lee

(74) *Attorney, Agent, or Firm* — Birch, Stewart, Kolasch & Birch, LLP

(57) ABSTRACT

Provided are a liquid crystal display device and a method of performing local dimming of the liquid crystal display device. The method of performing local dimming of the liquid crystal display device includes displaying an image with a single grayscale on a liquid crystal display panel, detecting an abnormal block where a light leakage or a black uniformity (BU) defect occurs among a plurality of blocks of the liquid crystal display panel, and calculating a dimming value for the abnormal block. Accordingly, a dimming value for each area where a light leakage or a black uniformity defect occurs can be calculated independently and the calculated dimming value can be applied to local dimming. Therefore, it is possible to reduce a light leakage and also is possible to address a black uniformity defect.

15 Claims, 11 Drawing Sheets

LIQUID CRYSTAL DISPLAY DEVICE AND METHOD OF PERFORMING LOCAL DIMMING OF THE SAME

CROSS-REFERENCE TO RELATED APPLICATIONS

This application claims the priority of Korean Patent Application No. 10-2016-0110941 filed on Aug. 30, 2016, in the Korean Intellectual Property Office, the disclosure of which is incorporated herein by reference.

BACKGROUND

Field

The present disclosure relates to a liquid crystal display device and a method of performing local dimming of the liquid crystal display device and more particularly, to a liquid crystal display device and a method of applying local dimming on the liquid crystal display device for solving a light leakage or a black uniformity (BU) defect occurring due to some characteristics of a display panel.

Description of the Related Art

Recently, as the world entered the information age, the field of display for visually displaying electrical information has grown rapidly. Thus, various flat display devices with high performance and characteristics, such as thin body, light weight, and low power consumption, have been developed and are being rapidly substituted for a conventional cathode ray tube (CRT).

Specifically, the flat display devices may include a liquid crystal display (LCD) device, an organic light emitting display (OLED) device, an electrophoretic display (EPD) device, a plasma display panel (PDP) device, and an electrowetting display (EWD) device. Particularly, in the LCD device, a liquid crystal display panel including a plurality of liquid crystal cells aligned in a matrix form displays an image by adjusting the transmittance of lights supplied from a backlight unit.

The LCD device displays an image by adjusting the light transmittance of liquid crystal using an electric field. The LCD device may be classified into a vertical electric field driving type LCD device or a horizontal electric field driving type LCD device depending on a direction of an electric field driving the liquid crystal. In the vertical electric field driving type LCD device, a common electrode formed on an upper substrate and a pixel electrode formed on a lower substrate are disposed to face each other and a vertical electric field formed therebetween drives the liquid crystal. The vertical electric field driving type LCD device has a high aperture ratio but also has a narrow viewing angle. Meanwhile, in the horizontal electric field driving type LCD device, a horizontal electric field formed between a pixel electrode and a common electrode formed on the same substrate may drive the liquid crystal in an in-plane switching (IPS) mode. The horizontal electric field driving type LCD device has a wide viewing angle and excellent color gamut due to its pixel structure.

However, in the horizontal electric field driving type LCD device as compared with the vertical electric field driving type LCD device, a light leakage is more likely to occur at an edge of the liquid crystal display panel due to its pixel structure. Further, in the horizontal electric field driving type LCD device, a BU defect, which means that a black region is not formed uniformly on the entire surface of the liquid crystal display panel and a bright spot occurs in part, is highly likely to occur.

Accordingly, studies for solving the light leakage and the black uniformity defect in an LCD device, particularly, a horizontal electric field driving type LCD device are being conducted.

SUMMARY

An object to be achieved by the present disclosure is to provide a liquid crystal display device and a method of performing local dimming of the liquid crystal display device capable of reducing brightness non-uniformity caused by a light leakage, by respectively applying different dimming values to an area where a light leakage occurs and an area where a light leakage does not occur.

Another object to be achieved by the present disclosure is to provide a liquid crystal display device and a method of performing local dimming of the liquid crystal display device capable of reducing a black uniformity defect by respectively applying different dimming values to an area where a black uniformity defect occurs and an area where a black uniformity defect does not occur.

Yet another object to be achieved by the present disclosure is to provide a liquid crystal display device and a method of applying local dimming on the liquid crystal display device having a uniform brightness when an image with a single grayscale is displayed by setting a different dimming value for each block, analyzing input data, and applying a gain for each pixel.

The objects of the present disclosure are not limited to the aforementioned objects, and other objects, which are not mentioned above, will be apparent to a person having ordinary skill in the art from the following description.

According to an embodiment of the present disclosure, there is provided a method of performing local dimming of a liquid crystal display device. The method of performing local dimming of the liquid crystal display device includes displaying an image with a single grayscale on a liquid crystal display panel, detecting an abnormal block where a light leakage or a black uniformity defect occurs among a plurality of blocks of the liquid crystal display panel, and calculating a dimming value for the abnormal block. Accordingly, a dimming value for each area where a light leakage or a black uniformity defect occurs can be calculated independently and the calculated dimming value can be applied to local dimming. Therefore, it is possible to reduce a light leakage and also possible to solve a black uniformity defect.

According to another embodiment of the present disclosure, there is provided a liquid crystal display device. The liquid crystal display device includes a liquid crystal display panel including a plurality of pixels, a backlight unit including a plurality of light sources, and a local dimming unit that drives the backlight unit based on the grayscale dimming value. The local dimming unit includes a memory in which grayscale dimming values for a plurality of blocks of the liquid crystal panel are stored. The memory of the local dimming unit stores different grayscale dimming values for an abnormal block where a light leakage or a black uniformity defect occurs and for a reference block among the plurality of blocks. Therefore, when the liquid crystal display device is local dimmed, the dimming values stored in the memory of the local dimming unit can be used. Then, a brightness of the abnormal block where a light leakage or a black uniformity defect occurs can be adjusted, and, thus, it is possible to acquire a uniform brightness on the entire liquid crystal display panel.

According to yet another embodiment of the present disclosure, there is provided a method of performing local dimming of a liquid crystal display device. The method of performing local dimming of the liquid crystal display device includes displaying an image with a single grayscale on a liquid crystal display panel, measuring brightnesses of a plurality of blocks of the liquid crystal display panel, and calculating dimming values for a central block and edge blocks among the plurality of blocks. Herein, the calculating of dimming values includes applying different dimming values to the central block and the edge blocks where a light leakage or a black uniformity defect occurs. Accordingly, a dimming value for each of the edge blocks where a light leakage or a black uniformity defect mainly occurs can be calculated independently. Thus, the edge blocks are not applied with the same dimming value, but applied with different dimming values, respectively. Therefore, it is possible to reduce a light leakage and also possible to solve a black uniformity defect.

Details of other exemplary embodiments will be included in the detailed description of the invention and the accompanying drawings.

According to the present disclosure, dimming values for a block where a light leakage occurs and a block where a light leakage does not occur are adjusted based on measured brightness values. Thus, it is possible to solve or address a light leakage which has not been solved/addressed by a conventional local dimming method.

Further, according to the present disclosure, when black uniformity is not uniform, different dimming values are respectively applied to blocks of a liquid crystal display panel. Thus, it is possible to solve or address a black uniformity defect of the liquid crystal display panel which has not been solved/addressed by the conventional local dimming method.

Furthermore, according to the present disclosure, input data are analyzed and a gain is applied at the same time when different dimming values are respectively applied to the blocks of the liquid crystal display panel. Thus, it is possible to acquire a uniform brightness from the plurality of blocks.

The effects of the present disclosure are not limited to the aforementioned effects, and various other effects are included in the present specification.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE EMBODIMENTS

Figure 1:
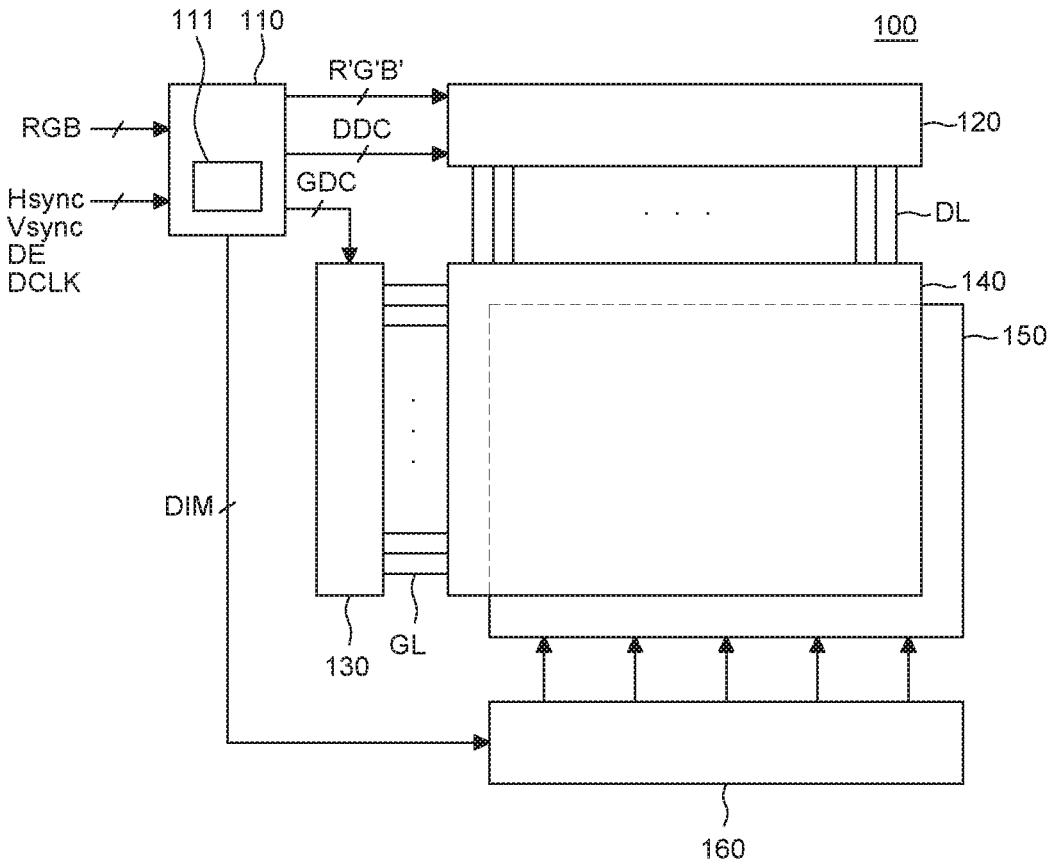
FIG. 1 is a block diagram provided to explain a liquid crystal display device according to an exemplary embodiment of the present disclosure.

Advantages and features of the present disclosure, and methods for accomplishing the same will be more clearly understood from exemplary embodiments described below with reference to the accompanying drawings. However, the present disclosure is not limited to the following exemplary embodiments but may be implemented in various different forms. The exemplary embodiments are provided only to complete disclosure of the present disclosure and to fully provide a person having ordinary skill in the art to which the present disclosure pertains with the category of the disclosure, and the present disclosure will be defined by the appended claims.

The shapes, sizes, ratios, angles, numbers, and the like illustrated in the accompanying drawings for describing the exemplary embodiments of the present disclosure are merely examples, and the present disclosure is not limited thereto. Like reference numerals generally denote like elements throughout the present specification. Further, in the following description, a detailed explanation of known related technologies may be omitted to avoid unnecessarily obscuring the subject matter of the present disclosure. The terms such as "including," "having," and "consist of" used herein are generally intended to allow other components to be added unless the terms are used with the term "only". Any references to singular may include plural unless expressly stated otherwise.

Components are interpreted to include an ordinary error range even if not expressly stated.

When the position relation between two parts is described using the terms such as "on", "above", "below", and "next", one or more parts may be positioned between the two parts unless the terms are used with the term "immediately" or "directly".

When an element or layer is referred to as being "on" another element or layer, it maybe directly on the other element or layer, or intervening elements or layers may be present.

Although the terms "first", "second", and the like are used for describing various components, these components are not confined by these terms. These terms are merely used for distinguishing one component from the other components. Therefore, a first component to be mentioned below may be a second component in a technical concept of the present disclosure.

Throughout the whole specification, the same reference numerals denote the same elements.

Since the size and thickness of each component illustrated in the drawings are represented for convenience in explanation, the present disclosure is not necessarily limited to the illustrated size and thickness of each component.

The features of various embodiments of the present disclosure can be partially or entirely bonded to or combined with each other and can be interlocked and operated in technically various ways, and the embodiments can be carried out independently of or in association with each other.

Hereinafter, various exemplary embodiments of the present disclosure will be described in detail with reference to the accompanying drawings.

Figure 2:
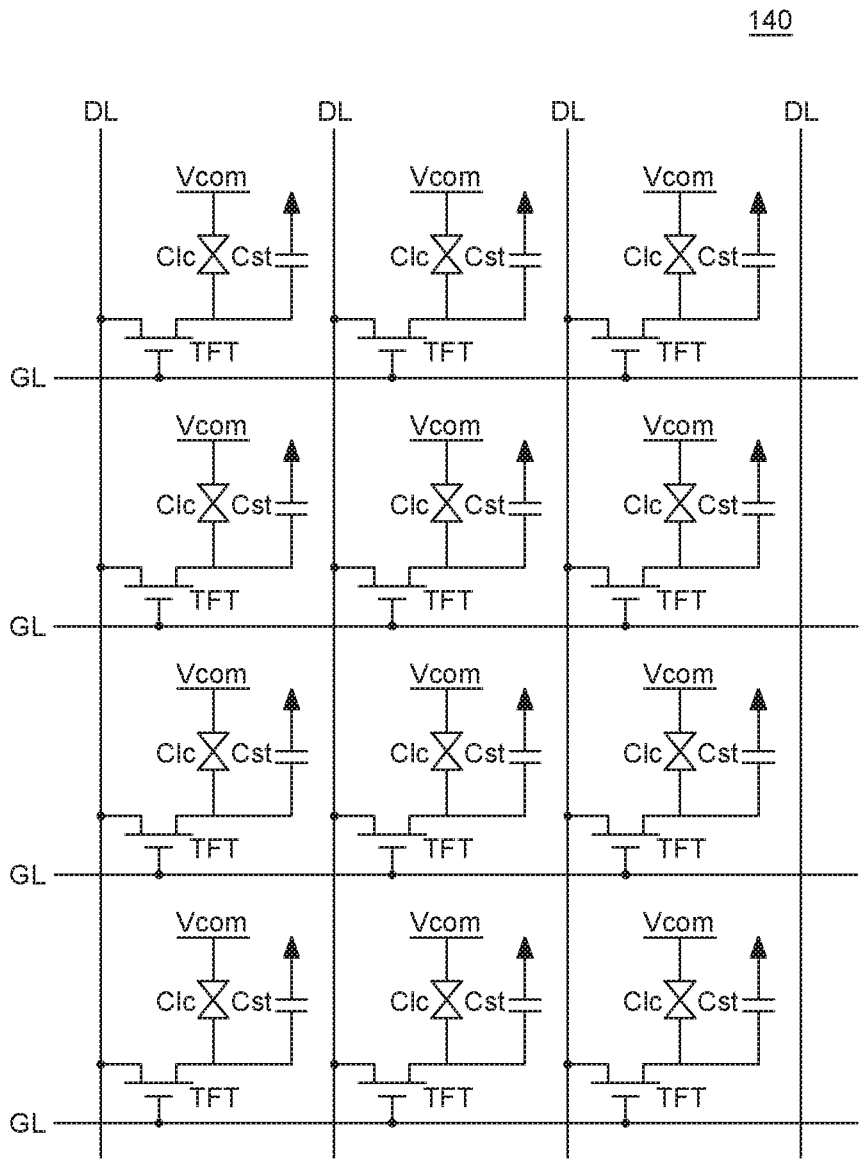
FIG. 2 is a circuit diagram equivalently illustrating a part of a pixel array of a liquid crystal display panel illustrated in FIG. 1.

FIG. 1 is a block diagram provided to explain a liquid crystal display device according to an exemplary embodiment of the present disclosure. FIG. 2 is a circuit diagram equivalently illustrating a part of a pixel array of a liquid crystal display panel illustrated in FIG. 1. All the components of the liquid crystal display device according to all embodiments of the present disclosure are operatively coupled and configured.

Referring to FIG. 1 and FIG. 2, a liquid crystal display device 100 includes a liquid crystal display panel 140, a backlight unit 160, a timing controller 110 which may include a local dimming unit 111, a data driver 120, a gate driver 130, and a system board 150.

The liquid crystal display panel 140 is a horizontal electric field driving type liquid crystal display panel. It is an IPS panel in which a horizontal electric field formed between a pixel electrode and a common electrode formed on the same substrate drives the liquid crystal in an IPS mode. However, the present disclosure is not limited thereto, and the liquid crystal display panel 140 may be a horizontal electric field driving type liquid crystal display panel serving as a fringe field switching (FFS) panel.

The liquid crystal display panel 140 has a structure in which a liquid crystal layer is disposed between substrates facing each other. On a lower substrate of the liquid crystal display panel 140, a plurality of data lines DL and a plurality of gate lines GL intersect with each other. Due to the intersection structure between the data lines DL and the gate lines GL, liquid crystal cells Clc are disposed on the liquid crystal display panel 140 in a matrix form as shown in FIG. 2 and thus a plurality of pixels are defined. On the lower substrate of the liquid crystal display panel 140, the data lines DL, the gate lines GL, thin film transistors TFT, pixel electrodes of the liquid crystal cells Clc connected to the thin film transistors TFT, common electrodes, and storage capacitors Cst may be formed. Further, on an upper substrate of the liquid crystal display panel 140, a black matrix and a color filter may be formed.

A polarization plate may be attached to each of the upper substrate and the lower substrate of the liquid crystal display panel 140. Further, an alignment film for setting a pretilt angle of liquid crystal may be formed within the upper substrate and the lower substrate of the liquid crystal display panel 140 in contact with the liquid crystal.

The data driver 120 may include a plurality of source drive ICs. The data driver 120 may latch digital video data R'G'B' under control of the timing controller 110. Further, the data driver 120 may convert the digital video data R'G'B' into positive/negative analog data voltages using positive/negative gamma compensation voltages and then supply the positive/negative analog data voltages to the data lines DL.

The gate driver 130 may include a plurality of gate drive ICs. The gate driver 130 may include a shift register, a level shifter for converting a swing width of an output signal of the shift register into a swing width suitable for driving the TFT of the liquid crystal cell Clc, and an output buffer. The gate driver 130 includes the plurality of gate drive ICs and thus can sequentially output gate pulses (or scan pulses) each having a pulse width of about 1 horizontal period and supply the gate pulses to the gate lines GL.

The timing controller 110 may control the data driver 120 and the gate driver 130. The timing controller 110 may receive digital video data RGB and timing signals Vsync, Hsync, DE, and DCLK from the system board 150 through an interface, such as a low voltage differential signaling (LVDS) interface and a transition minimized differential signaling (TMDS) interface. The timing signals Vsync, Hsync, DE, and DCLK may include a vertical synchronization signal Vsync, a horizontal synchronization signal Hsync, a data enable signal DE, and a dot clock signal DCLK. The timing controller 110 may generate timing control signals DDC and GDC for controlling operation timing of the data driver 120 and the gate driver 130 based on the timing signals Vsync, Hsync, DE, and DCLK input from the system board 150.

A data timing control signal DDC may include a source start pulse SSP, a source sampling clock SSC, a source output enable signal SOE, and a polarity control signal POL. The source start pulse SSP may control a start timing of a data sampling operation of the data driver 120. The source sampling clock SSC may control the data sampling operation within the data driver 120 based on a rising or falling edge. If a signal transmission system between the timing controller 110 and the data driver 120 is a mini LVDS interface, the source start pulse SSP and the source sampling clock SSC may be omitted. The polarity control signal POL may reverse the polarity of a data voltage output from the data driver 120 at n (n is a positive integer) horizontal periods. The source output enable signal SOE may control an output timing of the data driver 120.

The gate timing control signal may include a gate start pulse GSP, a gate shift clock GSC, and a gate output enable signal GOE. The gate start pulse GSP may control a timing of a first gate pulse. The gate shift clock GSC is a clock signal for shifting the gate start pulse GSP. The gate output enable signal GOE may control an output timing of the gate driver 130.

The timing controller 110 may map an input image to a plurality of blocks of the liquid crystal display panel 140 and analyze a correlation between image data and a backlight in each block. The timing controller 110 outputs a dimming signal DIM for the backlight unit 160 for local dimming depending on the correlation between image data and a backlight and compensates each block for data.

The timing controller 110 may include the local dimming unit 111 in order to output the dimming signal DIM to the backlight unit 160 for local dimming. However, the present disclosure is not limited thereto, and the local dimming unit 111 may be implemented as a component separate from the timing controller 110. The local dimming unit 111 includes a memory in which grayscale dimming values for the plurality of blocks of the liquid crystal panel 140 are stored. The memory may store different grayscale dimming values for an abnormal block where a light leakage or a black uniformity defect occurs and a reference block among the plurality of blocks. The local dimming unit 111 may output the dimming signal DIM based on a dimming value to drive the backlight unit 160 accordingly. More details of the local dimming unit 111 will be described later with reference to FIG. 3A through FIG. 8B.

The system board 150 supplies the digital video data RGB to the timing controller 110. The system board 150 includes a broadcast signal receiving circuit, an external device interface circuit, a graphic processing circuit, and the like. Thus, the system board 150 is configured to receive video data from a broadcast signal or an input source input from an external device, convert the video data into digital data, and supply the digital data to the timing controller 110. The system board 150 may supply the timing signals, such as the vertical synchronization signal Vsync, the horizontal synchronization signal Hsync, the data enable signal DE, and the dot clock signal DCLK, to the timing controller 110.

The backlight unit 160 may include a plurality of light sources. The backlight unit 160 may be implemented as a direct type backlight unit or an edge type backlight unit. The direct type backlight unit has a structure in which a plurality of optical sheets and a diffusion plate are laminated under the liquid crystal display panel 140 and a plurality of light sources is disposed under the diffusion plate. The direct type backlight unit can implement local dimming by disposing the plurality of light sources under the diffusion plate and individually controlling the plurality of light sources. The edge type backlight unit has a structure in which a light source is disposed to face a lateral surface of a light guide plate and a plurality of optical sheets is disposed between the liquid crystal display panel 140 and the light guide plate. The plurality of optical sheets includes at least one prism sheet and at least one diffusion sheet. Thus, the optical sheets diffuse light incident from the diffusion plate and refract a travel path of light at a substantially vertical angle to a light incident surface of the liquid crystal display panel 140. The plurality of optical sheets may include a dual brightness enhancement film (DBEF).

Hereinafter, a local dimming method for minimizing a light leakage and a black uniformity defect in the liquid crystal display panel 140 according to an exemplary embodiment of the present disclosure will be described with reference to FIG. 3A through FIG. 8B.

Figure 3A:
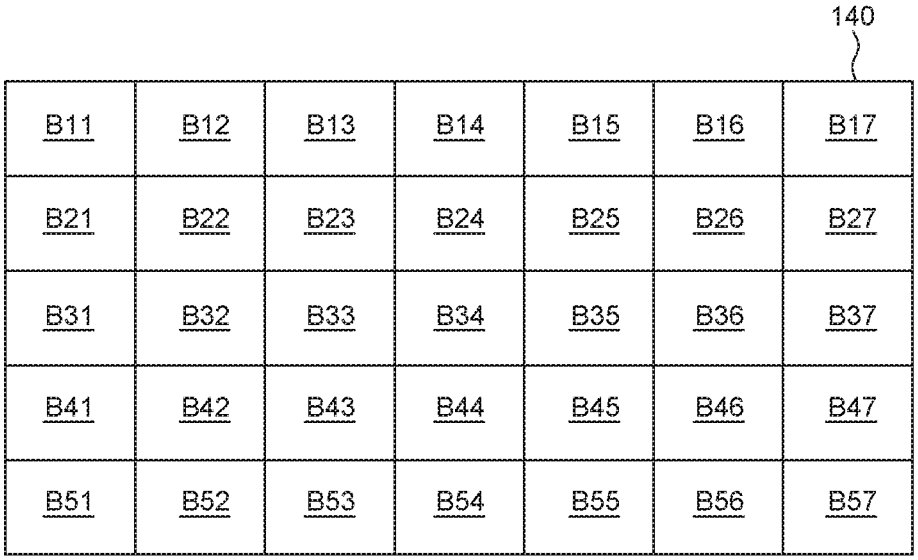
FIG. 3A is a schematic diagram provided to explain a plurality of blocks of the liquid crystal display panel illustrated in FIG. 1.

FIG. 3A is a schematic diagram provided to explain a plurality of blocks of the liquid crystal display panel illustrated in FIG. 1.

Referring to FIG. 3A, the liquid crystal display panel 140 includes a plurality of blocks B11 to B57 used for local dimming. The blocks B11 to B57 are not physically separated from each other, but they are virtual blocks for virtually separating the whole area of the liquid crystal display panel 140. FIG. 3A illustrates that the liquid crystal display panel 140 includes the plurality of blocks B11 to B57 in seven (7) rows and five (5) columns, but is not limited thereto. The liquid crystal display panel 140 may include a plurality of blocks in a certain number of rows and a certain number of columns. Each of the plurality of blocks B11 to B57 may include i×j (i and j are positive integers equal to or greater than 1) number of pixels. Each of the pixels may include sub-pixels for three (3) primary colors or more, and each sub-pixel may include a liquid crystal cell Clc.

Figure 3B:
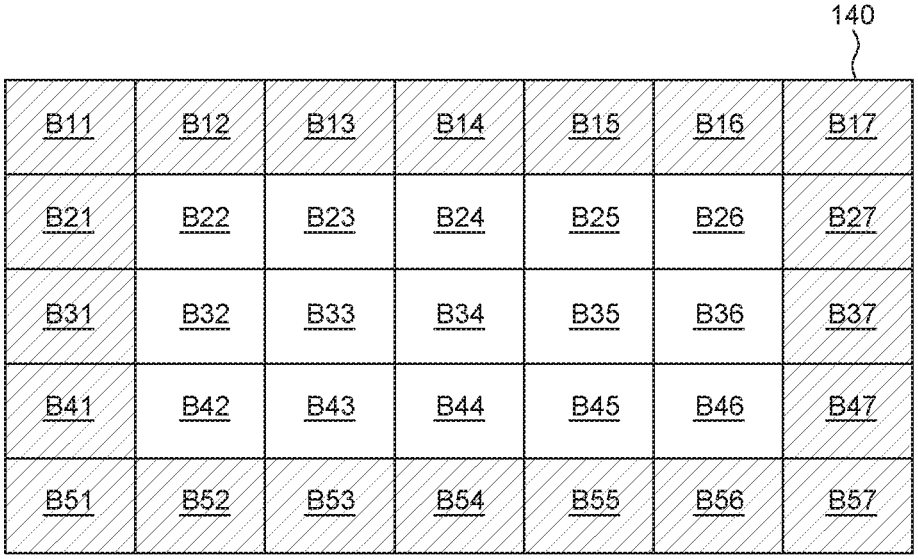
FIG. 3B is a schematic diagram provided to explain a problem caused by a light leakage.
Figure 3C:
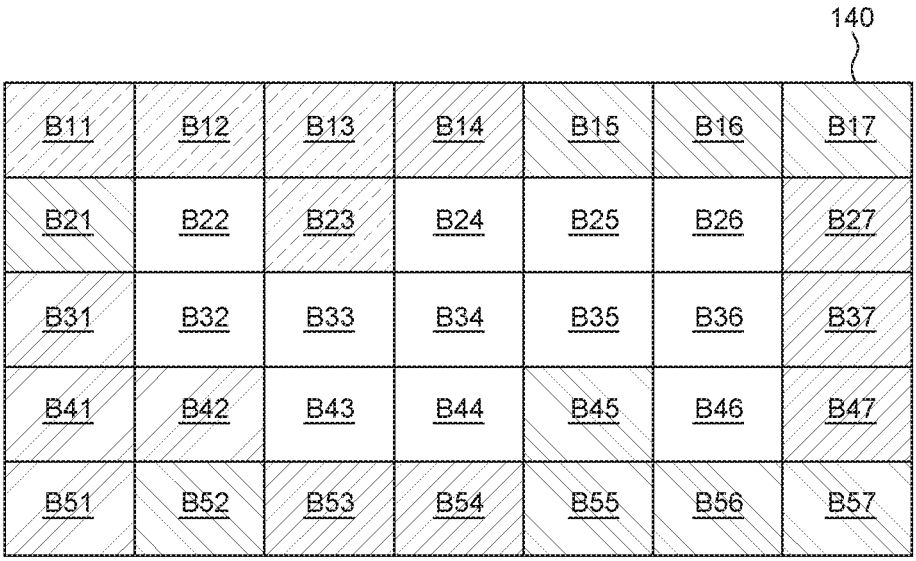
FIG. 3C is a schematic diagram provided to explain a problem caused by a black uniformity defect.

FIG. 3B is a schematic diagram provided to explain a problem caused by a light leakage. FIG. 3C is a schematic diagram provided to explain a problem caused by a black uniformity defect. FIG. 3B and FIG. 3C are schematic diagrams provided to explain cases where a light leakage and a black uniformity defect can occur, respectively, when an image with a single grayscale is displayed on the liquid crystal display panel 140. A hatching in each of the blocks B11 to B57 preferably means a brightness value measured from the corresponding block. That is, blocks with the same hatching are blocks from which the same brightness value is measured, and blocks with different hatchings are blocks from which different brightness values are measured. Further, blocks with no hatching are normal blocks. Herein, the image with a single grayscale refers to an image which is identical in grayscale of the whole image.

Referring to FIG. 3B, a light leakage may occur in the liquid crystal display panel 140. In this case, there may be a difference in brightness between blocks B11, B12, B13, B14, B15, B16, B17, B21, B27, B31, B37, B41, B47, B51, B52, B53, B54, B55, B56, and B57 at the edges of the liquid crystal display panel 140 and a block B34 at the center of the liquid crystal display panel 140. Specifically, even if an image with a specific grayscale is displayed on the liquid crystal display panel 140, if a light leakage occurs at an edge of the liquid crystal display panel 140, brightness values measured from the blocks B11, B12, B13, B14, B15, B16, B17, B21, B27, B31, B37, B41, B47, B51, B52, B53, B54, B55, B56, and B57 at the edges of the liquid crystal display panel 140 may be different from a brightness value measured from the block B34 at the center of the liquid crystal display panel 140. In this case, a user may have different visual sensations between the edges and the center of the liquid crystal display panel 140. Therefore, it is necessary to reduce the light leakage.

Then, referring to FIG. 3C, a black uniformity defect may occur in the liquid crystal display panel 140. In this case, there may be a difference in brightness among the plurality of blocks B11 to B57 of the liquid crystal display panel 140. Specifically, even if an image with a specific grayscale is displayed on the liquid crystal display panel 140, since black uniformity is not uniform on the liquid crystal display panel 140, various brightness values may be measured from the plurality of blocks B11 to B57. Particularly, various brightness values may be measured from the blocks B11, B12, B13, B14, B15, B16, B17, B21, B27, B31, B37, B41, B47, B51, B52, B53, B54, B55, B56, and B57 at the edges of the liquid crystal display panel 140. If a black uniformity defect occurs in the liquid crystal display panel 140 and different brightness values are measured from the plurality of blocks B11 to B57 as such, the user may have problems with a visual sensation, a contrast ratio (CR), expression of a grayscale of a black grayscale image. Therefore, it is necessary to address the black uniformity defect.

In the method of performing local dimming of the liquid crystal display device 100 according to an exemplary embodiment of the present disclosure, a dimming value is independently applied to an abnormal block where a light leakage or a black uniformity defect occurs in order to minimize the light leakage and solve the black uniformity defect.

Figure 4:
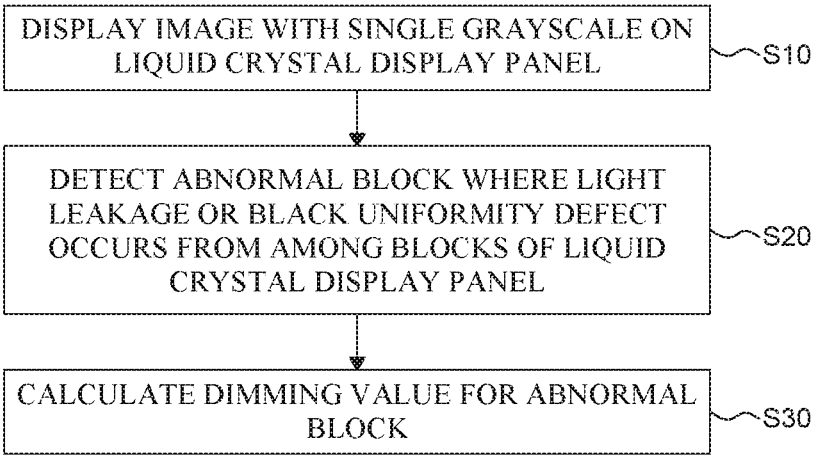
FIG. 4 is a flowchart provided to explain a method of local dimming of a liquid crystal display device according to an exemplary embodiment of the present disclosure.

FIG. 4 is a flowchart provided to explain a method of performing local dimming of a liquid crystal display device according to an exemplary embodiment of the present disclosure.

Referring to FIG. 4, firstly, an image with a single grayscale is displayed on the liquid crystal display panel 140 (S10).

The liquid crystal display panel 140 displays the image with a single grayscale in order to measure brightness of the plurality of blocks B11 to B57 of the liquid crystal display panel 140. That is, the image with one of grayscales ranging from the lowest grayscale to the highest grayscale which can be displayed on the liquid crystal display panel 140 is displayed on the liquid crystal display panel 140. For example, an image with a certain grayscale of from 0 to 255 is displayed on the liquid crystal display panel 140. Thus, it is possible to detect an abnormal block where a light leakage or a black uniformity defect occurs based on the grayscale of the image displayed on the liquid crystal display panel 140.

Further, the liquid crystal display panel 140 may sequentially display a plurality of images each having a grayscale from the lowest grayscale to the highest grayscale. For example, a plurality of images each having a grayscale of from 0 to 255 may be displayed on the liquid crystal display panel 140. Thus, it is possible to detect an abnormal block where a light leakage or a black uniformity defect occurs based on each grayscale which can be displayed on the liquid crystal display panel 140. Herein, the order of grayscales of a plurality of images to be displayed on the liquid crystal display panel 140 may be set in various ways. That is, the liquid crystal display panel 140 may display a plurality of images in the order of grayscales of from 0 to 255 or may display a plurality of images in the order of grayscales of from 255 to 0. Otherwise, the liquid crystal display panel 140 may randomly display a plurality of images each having a grayscale of from 0 to 255.

Then, an abnormal block where a light leakage or a black uniformity defect occurs is detected among the plurality of blocks B11 to B57 of the liquid crystal display panel 140 (S20). The process of detecting an abnormal block will be described in more detail with reference to FIG. 5A.

Figure 5A:
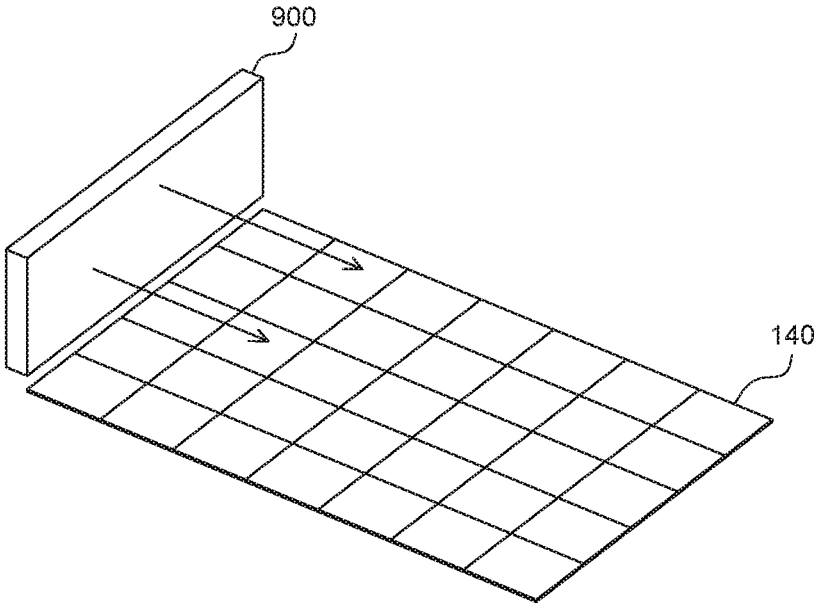
FIG. 5A is a perspective view provided to explain a process of scanning a liquid crystal display panel in a method of performing local dimming of a liquid crystal display device according to an exemplary embodiment of the present disclosure.

FIG. 5A is a perspective view provided to explain a process of scanning a liquid crystal display panel in the method of performing local dimming of a liquid crystal display device according to an exemplary embodiment of the present disclosure.

Referring to FIG. 5A, firstly, while an image with a single grayscale is displayed on the liquid crystal display panel 140 as described above, a scanning process is performed to the liquid crystal display panel 140. For example, as illustrated in FIG. 5A, while an image with a single grayscale is displayed on the liquid crystal display panel 140, a surface scanning process may be performed to the liquid crystal display panel 140 using a scanner 900. As a result of the surface scanning process, brightness values of the plurality of blocks B11 to B57 of the liquid crystal display panel 140 may be measured.

In an exemplary embodiment, the scanning process to the liquid crystal display panel 140 may be performed as an in-line process with a producing process of the liquid crystal display panel 140. That is, the scanner 900 may be provided at a production line for producing the liquid crystal display panel 140, and when the liquid crystal display panel 140 is disposed corresponding to the scanner 900, an image is displayed. Then, while the liquid crystal display panel 140 moves along the production line, the scanning process may be performed to the liquid crystal display panel 140 using the scanner 900 provided at the production line. As such, if the scanning process is performed as an in-line process with the producing process of the liquid crystal display panel 140, the scanning process can be more efficiently performed through automatic production of the liquid crystal display panel 140.

In another exemplary embodiment, the scanning process to the liquid crystal display panel 140 may be performed separately from the producing process of the liquid crystal display panel 140. That is, after the liquid crystal display panel 140 is completely produced, the scanning process may be performed as a spate process to the liquid crystal display panel 140 using the scanner 900.

Through the scanning process described above, brightness values of the plurality of blocks B11 to B57 with respect to the grayscale of the image displayed on the liquid crystal display panel 140 may be measured. For example, if the image displayed on the liquid crystal display panel 140 has a first grayscale, brightness values of the plurality of blocks B11 to B57 with respect to the first grayscale may be measured. Herein, a brightness value of a specific value maybe an average value of brightness values measured from the specific block. However, the present disclosure is not limited thereto. The brightness value of the specific value may be defined as a mode of various brightness values, or may be defined in another way.

Further, if the plurality of images each having a grayscale from the lowest grayscale to the highest grayscale is displayed on the liquid crystal display panel 140 as described above, the scanning process may be performed while each image is displayed. Therefore, brightness values may be measured from the plurality of blocks B11 to B57 of the liquid crystal display panel 140 with respect to each grayscale. For example, the scanning process may be performed while the plurality of images is sequentially displayed in the order of grayscales of from 0 to 255. Thus, brightness values of the plurality of blocks B11 to B57 of the liquid crystal display panel 140 with respect to each grayscale of from 0 to 255 may be measured.

Then, an abnormal block is detected among the plurality of blocks B11 to B57 based on the brightness values measured through the scanning process. The process of detecting an abnormal block will be described in more detail with reference to FIG. 5B and FIG. 5C.

Figure 5B:
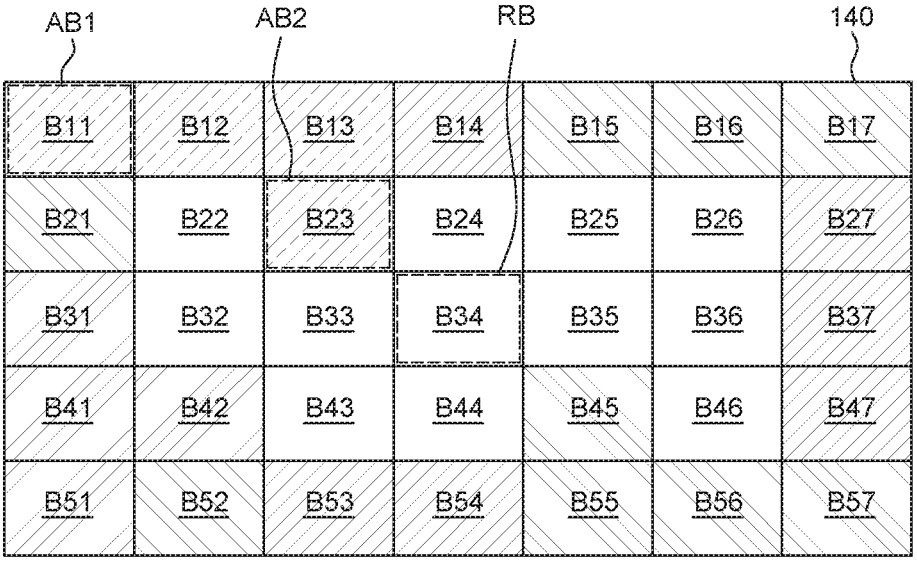
FIG. 5B is a schematic diagram provided to explain a brightness value acquired by displaying an image with a first grayscale on a liquid crystal display panel and scanning the liquid crystal display panel in a method of performing local dimming of a liquid crystal display device according to an exemplary embodiment of the present disclosure.

FIG. 5B is a schematic diagram provided to explain a brightness value acquired by displaying an image with a first grayscale on a liquid crystal display panel and scanning the liquid crystal display panel in a method of performing local dimming of a liquid crystal display device according to an exemplary embodiment of the present disclosure. FIG. 5B is an exemplary diagram showing a brightness value acquired by displaying the image with the first grayscale on the liquid crystal display panel 140 and performing the scanning process. A hatching in each of the blocks B11 to B57 means a brightness value measured from the corresponding block. That is, blocks with the same hatching are blocks from which the same brightness value is measured, and blocks with different hatchings are blocks from which different brightness values are measured. Further, blocks with no hatching are normal blocks.

An abnormal block with respect to the first grayscale may be detected among the plurality of blocks B11 to B57 based on the brightness values measured through the scanning process. The abnormal block among the plurality of blocks B11 to B57 may be a block with a brightness value different from that of the reference block RB. Herein, the reference block RB may be the block B34 at the center of the liquid crystal display panel 140 among the plurality of blocks B11 to B57. A light leakage and a black uniformity defect mainly occur at the edges of the liquid crystal display panel 140. Thus, the block B34 at the center of the liquid crystal display panel 140 is highly likely to be a normal block. Thus, the number of abnormal blocks may be increased from the center to the edges of the liquid crystal display panel 140. Therefore, the reference block RB used for detecting an abnormal block may be the block B34 at the center of the liquid crystal display panel 140 among the plurality of blocks B11 to B57.

Among the plurality of blocks B11 to B57, a block with a different brightness value from the brightness value of the reference block RB is detected as an abnormal block with respect to the first grayscale. For example, in an exemplary embodiment illustrated in FIG. 5B, hatched blocks B11, B12, B13, B14, B15, B16, B17, B21, B23, B27, B31, B37, B41, B42, B45, B47, B51, B52, B53, B54, B55, B56, and B57 are detected as abnormal blocks with respect to the first grayscale.

Figure 5C:
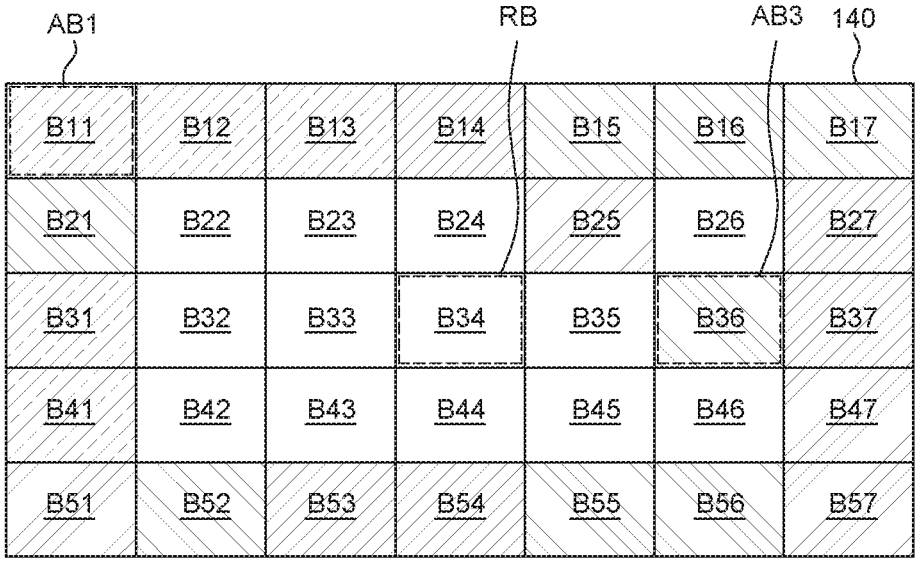
FIG. 5C is a schematic diagram provided to explain a brightness value acquired by displaying an image with a second grayscale on a liquid crystal display panel and scanning the liquid crystal display panel in a method of performing local dimming of a liquid crystal display device according to an exemplary embodiment of the present disclosure.

FIG. 5C is a schematic diagram provided to explain a brightness value acquired by displaying an image with a second grayscale on a liquid crystal display panel and scanning the liquid crystal display panel in a method of performing local dimming of a liquid crystal display device according to an exemplary embodiment of the present disclosure. FIG. 5C is an exemplary diagram showing a brightness value acquired by displaying the image with the second grayscale on the liquid crystal display panel 140 and performing the scanning process. A hatching in each of the blocks B11 to B57 means a brightness value measured from the corresponding block. That is, blocks with the same hatching are blocks from which the same brightness value is measured, and blocks with different hatchings are blocks from which different brightness values are measured. Further, blocks with no hatching are normal blocks.

An abnormal block with respect to the first grayscale may be detected among the plurality of blocks B11 to B57 based on the brightness values measured through the scanning process. That is, it is possible to detect an abnormal block with respect to the second gray scale different from the first grayscale among a plurality of grayscales ranging from the lowest grayscale to the highest grayscale which can be displayed on the liquid crystal display panel 140. The process of detecting an abnormal block with respect to the second grayscale is substantially the same as the process of detecting an abnormal block with respect to the first grayscale. That is, an abnormal block may be a block with a different brightness value from the brightness value of the reference block RB among the plurality of blocks B11 to B57. The reference block RB may be the block B34 at the center of the liquid crystal display panel 140 among the plurality of blocks B11 to B57.

The brightness is measured from the plurality of blocks B11 to B57 while the image with the second grayscale different from the first grayscale. Therefore, an abnormal block with respect to the first grayscale may be different from an abnormal block with respect to the second grayscale. That is, a light leakage and a black uniformity defect may occur in a different way depending on a grayscale of an image displayed on the liquid crystal display panel 140. Therefore, an abnormal block detected based on the brightness measured while the image with the first grayscale is displayed as illustrated in FIG. 5B may be different from an abnormal block detected based on the brightness measured while the image with the second grayscale is displayed as illustrated in FIG. 5C. For example, a block B23 detected as a second abnormal block AB2 in FIG. 5B may not be detected as an abnormal block in FIG. 5C. Further, a block B36 which is not detected as an abnormal block in FIG. 5B may be detected as a third abnormal block in FIG. 5C. However, some blocks, such as a block B11, of the plurality of blocks B11 to B57 may be detected as the first abnormal block AB1 in both of FIG. 5B and FIG. 5C.

FIG. 5B and FIG. 5C illustrate that an abnormal block with respect to the first grayscale is different from an abnormal block with respect to the second grayscale, but an abnormal block with respect to the first grayscale maybe identical to an abnormal block with respect to the second grayscale. Whether or not there is an abnormal block, i.e., whether or not a light leakage and a black uniformity defect occurs in the liquid crystal display panel 140, may be different for each liquid crystal display panel 140. Therefore, in a specific liquid crystal display panel 140, an abnormal block with respect to the first grayscale maybe different from an abnormal block with respect to the second grayscale. In another liquid crystal display panel 140, an abnormal block with respect to the first grayscale maybe identical to an abnormal block with respect to the second grayscale.

An abnormal block with respect to each of grayscales ranging from the lowest grayscale to the highest grayscale may be detected among the plurality of blocks B11 to B57 in the same manner as described above. That is, the above-described detecting process may be repeatedly performed with respect to each of grayscales of from 0 to 255 to detect abnormal blocks with respect to all of the grayscales.

Then, a dimming value for the abnormal block is calculated (S30 in FIG. 4).

A dimming value for the abnormal block is calculated based on the brightness measured with respect to each grayscale. That is, as for an abnormal block where a light leakage occurs and a brightness different from that of the reference block RB is measured or a black uniformity defect occurs and a brightness different from that of the reference block RB is measured, a dimming curve different from that of the reference block RB is applied. Thus, a dimming value for the abnormal block is calculated such that all of the blocks B11 to B57 of the liquid crystal display panel 140 have the same brightness at the same grayscale and secure black uniformity. Therefore, the reference block RB which is the block B34 at the center among the plurality of blocks B11 to B57 may have a different dimming value from that of the blocks B11, B12, B13, B14, B15, B16, B17, B21, B27, B31, B37, B41, B47, B51, B52, B53, B54, B55, B56, and B57 which are at the edges and in which a light leakage or a black uniformity defect occurs.

The following equation is used for calculating a dimming value for an abnormal block.

Dimming value for abnormal block=(Brightness measured from abnormal block/Brightness measured form reference block)*Dimming value for reference block [Equation]

There may be a reference dimming curve for the liquid crystal display device 100 in order to drive the liquid crystal display device 100 in a local dimming manner. The reference dimming curve refers to a dimming curve for the reference block RB. Herein, even if an image with the same grayscale is displayed on the liquid crystal display panel 140 as described above, a different brightness may be measured from each of the plurality of blocks B11 to B57 due to a light leakage and a black uniformity defect. Thus, in the method of performing local dimming of the liquid crystal display panel 140 according to an exemplary embodiment of the present disclosure, different dimming values may be respectively applied to the abnormal block and the reference block RB using the above Equation.

For example, a brightness measured from the reference block RB with respect to the first grayscale may be Y1, a brightness measured from the abnormal block with respect to the first grayscale maybe Y2, and a dimming value for the reference block RB with respect to the first grayscale may be is X %. In this case, a dimming value for the abnormal block with respect to the first grayscale is calculated as (Y2/Y1)*X %. For example, the brightness measured from the reference block RB with respect to the first grayscale maybe higher than the brightness measured from the abnormal block. In this case, the dimming value for the abnormal block with respect to the first grayscale is lower than the dimming value for the reference block RB with respect to the first grayscale. On the contrary to this, the brightness measured from the reference block RB with respect to the first grayscale may be lower than the brightness measured from the abnormal block. In this case, the dimming value for the abnormal block with respect to the first grayscale is higher than the dimming value for the reference block RB with respect to the first grayscale.

A process of calculating a dimming value for an abnormal block using the above Equation may be repeated for each grayscale. For example, a dimming value for a block detected as an abnormal block with respect to each grayscale of from 0 to 255 can be calculated using the above Equation. Therefore, a unique dimming value for each of the blocks B11 to B57 can be calculated and can be expressed as a dimming curve.

Further, when a dimming value for an abnormal block is calculated using the above Equation, a dimming value may be independently applied to each of the blocks B11, B12, B13, B14, B15, B16, B17, B21, B27, B31, B37, B41, B47, B51, B52, B53, B54, B55, B56, and B57 at the edges. For example, different brightness values are respectively measured from a block B11 and a block B17 among the blocks B11, B12, B13, B14, B15, B16, B17, B21, B27, B31, B37, B41, B47, B51, B52, B53, B54, B55, B56, B57 at the edges. Thus, a first dimming value may be applied to the block B11 and a second dimming value different from the first dimming value may be applied to the block B17. Therefore, different dimming curves may be respectively applied to the block B11 and the block B17.

Figure 6A:
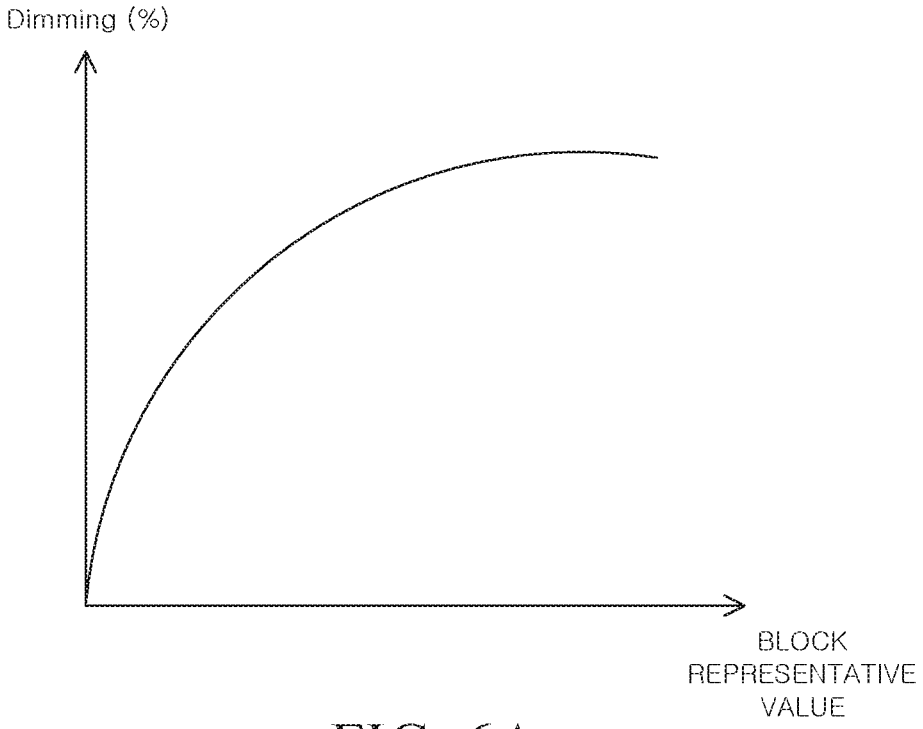
FIG. 6A is a graph showing an example of a dimming curve of a reference block.
Figure 6B:
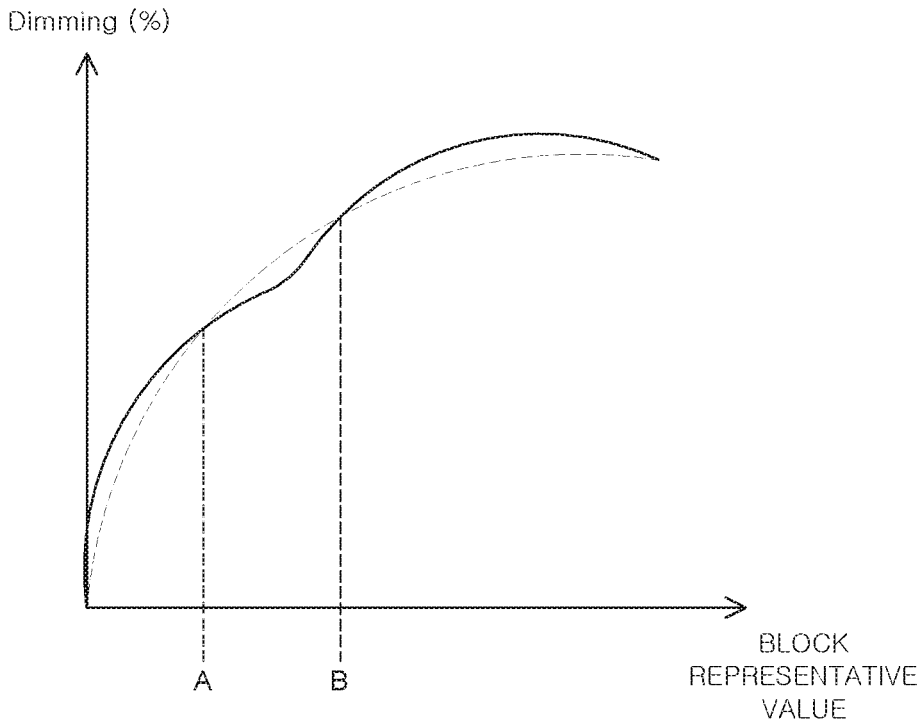
FIG. 6B is a graph showing an example of a dimming curve of an abnormal block.

FIG. 6A is a graph showing an example of a dimming curve of a reference block. FIG. 6B is a graph showing an example of a dimming curve of an abnormal block. For example, FIG. 6A illustrates an example of a dimming curve for the reference block RB illustrated in FIGS. 5B and 5C, and FIG. 6B illustrates an example of a dimming curve for the block B11 illustrated as the first abnormal block AB1 in FIGS. 5B and 5C. In the graphs of FIGS. 6A and 6B, the X-axis represents a block representative value, i.e., a grayscale of an input image, and the Y-axis represents a dimming value (%). In FIG. 6B, a dimming curve for the reference block RB is illustrated by a dotted line and a dimming curve for the first abnormal block AB1 is illustrated by a solid line for comparison.

As described above, when a dimming value for an abnormal block with respect to each grayscale is calculated using the above Equation, different dimming curves may be respectively applied to the first abnormal block AB1 and the reference block RB as illustrated in FIG. 6B. For example, at a grayscale lower than A as illustrated in FIG. 6B, a dimming value for the first abnormal block AB1 maybe higher than a dimming value for the reference block RB. Also, at a grayscale between A and B, a dimming value for the first abnormal block AB1 may be lower than a dimming value for the reference block RB. Further, at a grayscale higher than B, a dimming value for the first abnormal block AB1 may be higher than a dimming value for the reference block RB.

Also, a different dimming curve maybe set for each abnormal block. That is, as described above, an abnormal block may have a different brightness at each grayscale, and a block detected as an abnormal block at a specific grayscale maybe detected as a normal block at another grayscale. Therefore, a different dimming curve may be set for each of the plurality of blocks B11 to B57 of the liquid crystal display panel 140.

Then, the calculated dimming values may be stored in the liquid crystal display device 100.

Specifically, the calculated dimming values for the plurality of blocks B11 to B57 of the liquid crystal display panel 140 with respect to each grayscale maybe stored in the local dimming unit 111 that drives the backlight unit 160. That is, the calculated dimming values may be stored in the memory of the local dimming unit 111. However, the present disclosure is not limited thereto. The calculated dimming values may be stored in a certain memory which the local dimming unit 111 can access in order to drive the backlight unit 160.

Figure 7:
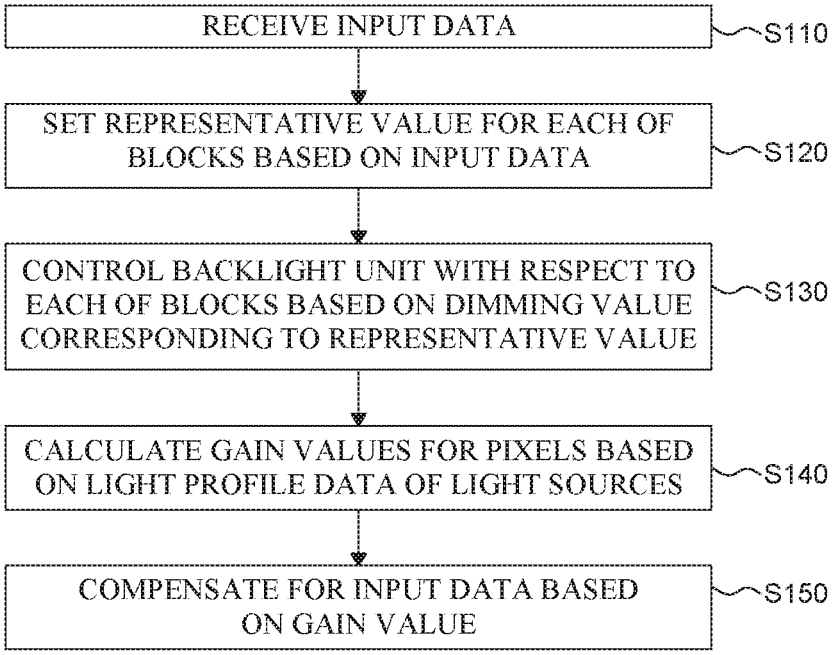
FIG. 7 is a flowchart provided to explain a local dimming driving method set by a method of performing local dimming of a liquid crystal display device according to an exemplary embodiment of the present disclosure.

FIG. 7 is a flowchart provided to explain a local dimming driving method set by a method of performing local dimming of a liquid crystal display device according to an exemplary embodiment of the present disclosure.

Referring to FIG. 7, firstly, the local dimming unit 111 receives input data (S110).

The timing controller 110 of the liquid crystal display device 100 receives input data, i.e., digital video data RGB, from the system board 150. Herein, the input data are defined as data about one frame of an input image. If the local dimming unit 111 is included in the timing controller 110 as illustrated in FIG. 1, the local dimming unit 111 may use the input data received by the timing controller 110. If the local dimming unit 111 is disposed outside the timing controller 110, the local dimming unit 111 may receive the input data from the timing controller 110.

Then, the local dimming unit 111 sets a representative value for each of the plurality of blocks B11 to B57 based on the input data (S120).

The local dimming unit 111 sets a representative value for each block by analyzing the input data for each block of the liquid crystal display panel 140. The local dimming unit 111 may detect a maximum grayscale value for each pixel in a frame from the input data and average maximum grayscale values for each pixel included in the respective blocks B11 to B57. Thus, an average value for each block can be set as a block representative value. However, the present disclosure is not limited thereto. A mode for each block may be set as a block representative value, or another method may be used to set a block representative value.

Then, the local dimming unit 111 controls the backlight unit 160 with respect to each of the plurality of blocks B11 to B57 based on a dimming value corresponding to the representative value (S130).

As described above, the calculated dimming values for the plurality of blocks B11 to B57 of the liquid crystal display panel 140 with respect to each grayscale may be stored in the local dimming unit 111, e.g., in the memory of the local dimming unit 111. Then, the local dimming unit 111 may determine a local dimming value for each block with respect to each of the plurality of blocks B11 to B57 based on a dimming value corresponding to a block representative value stored in the memory. The local dimming unit 111 may drive the backlight unit 160 for each of the plurality of blocks B11 to B57 of the liquid crystal display panel 140 using the determined local dimming value for each block and thus control a backlight brightness of each block.

Then, the local dimming unit 111 calculates gain values for a plurality of pixels based on light profile data of a plurality of light sources (S140).

For example, the local dimming unit 111 selects light profile data previously set as a dimming value for each block and calculates the amount of light of each of pixels in a specific block. The light profile data may be calculated as the sum of the amount of light of a specific pixel and the amount of a light reaching the specific pixel from pixels adjacent to the specific pixel during local dimming. Otherwise, the light profile data may be calculated through a prior experiment for measuring a brightness of each pixel by performing local dimming with a dimming value for each block. The local dimming unit 111 may calculate the sum of the amounts of light reaching a specific pixel from a plurality of light sources adjacent to the specific pixel when the entire backlight has a maximum brightness as a first total amount of light based on the light profile data. Further, the local dimming unit 111 may calculate a second total amount of light reaching the specific pixel from the plurality of adjacent light sources when the brightness of the backlight is adjusted for each block depending on a dimming value by multiplying a dimming value for each block and each amount of light reaching the specific pixel from the plurality of light sources and adding up the results. Then, the local dimming unit 111 may calculate a gain value for the specific pixel using a ratio of the first total amount of light to the second total amount of light. However, the above-described process of calculating a gain value is an example and may be modified in various ways.

Then, the local dimming unit 111 compensates for the input data based on the gain value (S150).

The local dimming unit 111 uses a gain value calculated for each of a plurality of pixels to compensate for input data of the corresponding pixel. For example, the local dimming unit 111 may compensate for input data by multiplying the input data of each of a plurality of pixels and a gain value calculated for the corresponding pixel. The input data, i.e., digital video data R'G'B', compensated as described above may be supplied to the data driver 120 through the timing controller 110.

As described above, a light leakage and a black uniformity defect may occur in the liquid crystal display panel. Particularly, the blocks B11, B12, B13, B14, B15, B16, B17, B21, B27, B31, B37, B41, B47, B51, B52, B53, B54, B55, B56, and B57 at the edges of the liquid crystal display panel and the block B34 at the center may have a difference in brightness. If there is a difference in brightness as such, the user may have problems with a visual sensation, a contrast ratio (CR), expression of a grayscale of an image. Particularly, if the liquid crystal display panel 140 is a horizontal electric field driving type liquid crystal display panel such as an IPS panel, a light leakage or a black uniformity defect is highly likely to occur.

Accordingly, in the liquid crystal display device 100 and the method of performing local dimming a liquid crystal display device according to an exemplary embodiment of the present disclosure, a dimming value may be separately set for an abnormal block in which a light leakage or a black uniformity defect occurs and from which a brightness value different from that of the reference block RB, i.e., normal block, at the same grayscale is measured. The dimming value may be stored in the memory. Therefore, when the liquid crystal display device 100 is driven, a dimming curve stored in the memory is applied to each of the plurality of blocks B11 to B57 in consideration of a light leakage or a black uniformity defect. Then, input data of each pixel are compensated. Thus, a light leakage in the liquid crystal display panel 140 can be reduced and black uniformity can be improved. Therefore, if an image with a single grayscale is displayed on the liquid crystal display panel 140 of the liquid crystal display device 100, the same brightness value may be measured from the plurality of blocks B11 to B57 of the liquid crystal display panel 140.

Figure 8A:
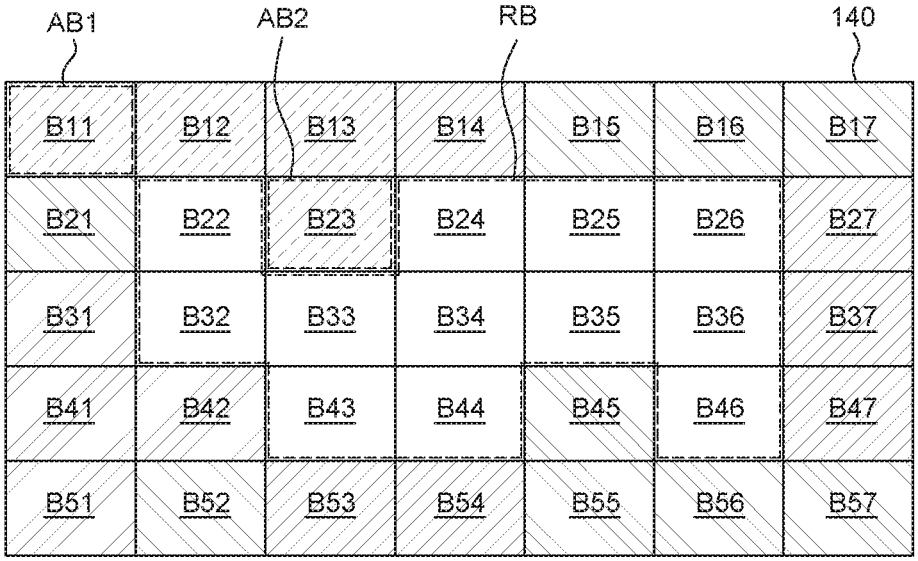
FIG. 8A is a schematic diagram provided to explain a brightness value acquired by displaying an image with a first grayscale on a liquid crystal display panel and scanning the liquid crystal display panel in a method of performing local dimming of a liquid crystal display device according to another exemplary embodiment of the present disclosure.

FIG. 8A is a schematic diagram provided to explain a brightness value acquired by displaying an image with a first grayscale on a liquid crystal display panel and scanning the liquid crystal display panel in a method of performing local dimming of a liquid crystal display device according to another exemplary embodiment of the present disclosure. FIG. 8A is an exemplary diagram showing a brightness value acquired by displaying an image with the first grayscale on the liquid crystal display panel 140 and performing the scanning process. FIG. 8A illustrates an exemplary embodiment different from the exemplary embodiment illustrated in FIG. 5B in a method of determining the reference block RB.

An abnormal block among the plurality of blocks B11 to B57 may be a block with a brightness different from a brightness measured from the reference block RB. Herein, the reference block RB may be a block with a brightness corresponding to a mode among brightnesses respectively measured from the plurality of blocks B11 to B57. A light leakage and a black uniformity defect mainly occur at the edges of the liquid crystal display panel 140. Thus, most of the blocks disposed around the center of the liquid crystal displaypanel 140 are highly likely to be normal blocks. Therefore, a block with a brightness value corresponding to a mode among brightness values measured when an image with a single grayscale is displayed on the liquid crystal display panel 140 may be the reference block RB. In the exemplary embodiment illustrated in FIG. 8A, non-hatched blocks B22, B24, B25, B26, B32, B33, B34, B35, B36, B43, B44, and B46 are the greatest in number among the plurality of blocks B11 to B57. Thus, the non-hatched blocks B22, B24, B25, B26, B32, B33, B34, B35, B36, B43, B44, and B46 may be defined as the reference blocks RB.

A block with a brightness different from a brightness measured from the reference blocks RB among the plurality of blocks B11 to B57 is detected as an abnormal block with respect to the first grayscale. For example, in the exemplary embodiment illustrated in FIG. 8A, all of hatched blocks B11, B12, B13, B14, B15, B16, B17, B21, B23, B27, B31, B37, B41, B42, B45, B47, B51, B52, B53, B54, B55, B56, and B57 are detected as abnormal blocks with respect to the first grayscale.

Figure 8B:
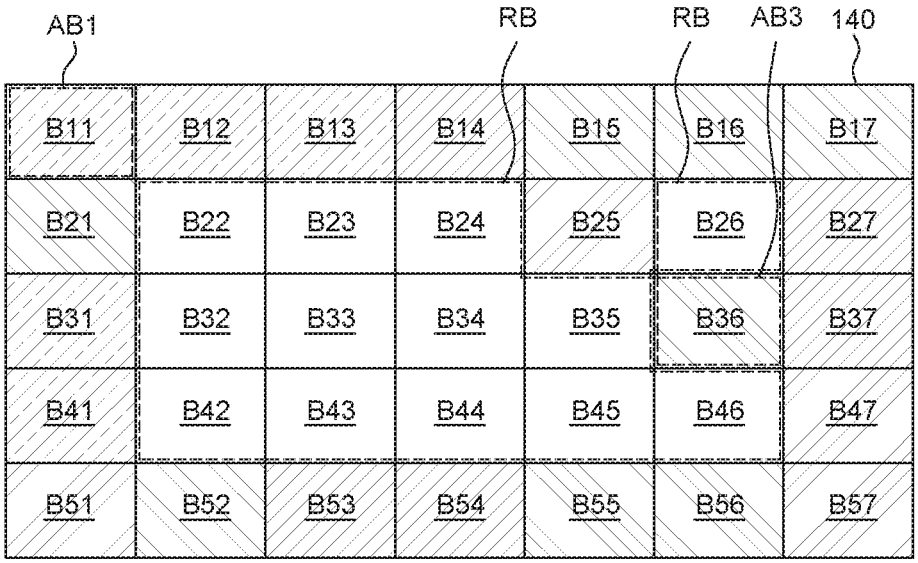
FIG. 8B is a schematic diagram provided to explain a brightness value acquired by displaying an image with a second grayscale on a liquid crystal display panel and scanning the liquid crystal display panel in a method of performing local dimming of a liquid crystal display device according to another exemplary embodiment of the present disclosure.

FIG. 8B is a schematic diagram provided to explain a brightness value acquired by displaying an image with a second grayscale on a liquid crystal display panel and scanning the liquid crystal display panel in a method of performing local dimming of a liquid crystal display device according to another exemplary embodiment of the present disclosure. FIG. 8B is an exemplary diagram showing a brightness value acquired by displaying an image with the second grayscale on the liquid crystal display panel 140 and performing the scanning process. FIG. 8B illustrates an exemplary embodiment different from the exemplary embodiment illustrated in FIG. 5C in a method of determining the reference block RB.

An abnormal block among the plurality of blocks B11 to B57 may be a block with a brightness different from a brightness measured from the reference block RB. As described above, the reference block RB may be a block with a brightness corresponding to a mode among brightnesses respectively measured from the plurality of blocks B11 to B57. Therefore, in the exemplary embodiment illustrated in FIG. 8B, non-hatched blocks B22, B23, B24, B26, B32, B33, B34, B35, B42, B43, B44, B45, and B46 are the greatest in number among the plurality of blocks B11 to B57. Thus, the non-hatched blocks B22, B23, B24, B26, B32, B33, B34, B35, B42, B43, B44, B45, and B46 may be defined as the reference blocks RB.

In the method of performing local dimming of the liquid crystal display device according to another exemplary embodiment of the present disclosure, a block with a brightness corresponding to a mode among brightnesses respectively measured from the plurality of blocks B11 to B57 is set as the reference block RB. That is, a light leakage and a black uniformity defect mainly occur in blocks B11, B12, B13, B14, B15, B16, B17, B21, B27, B31, B37, B41, B47, B51, B52, B53, B54, B55, B56, and B57 at the edges of the liquid crystal display panel 140, and, thus, most of the blocks are highly likely to be normal blocks. Therefore, a block with a brightness corresponding to the mode maybe defined as the reference block RB. Accordingly, even if a black uniformity defect occurs in a block at the center of the liquid crystal display panel 140, it is possible to normally detect an abnormal block and also possible to normally calculate a dimming value for the abnormal block.

The liquid crystal display device and the method of performing local dimming of the liquid crystal display device according to exemplary embodiments of the present disclosure can also be described as follows.

A method of performing local dimming of a liquid crystal display device may include displaying an image with a single grayscale on a liquid crystal display panel, detecting an abnormal block where a light leakage or a black uniformity (BU) defect occurs among a plurality of blocks of the liquid crystal display panel, and calculating a dimming value for the abnormal block.

According to another aspect of the present disclosure, the displaying of the image may include displaying a plurality of images each having a grayscale from the lowest grayscale to the highest grayscale. The detecting of the abnormal block may include detecting the abnormal block among the plurality of blocks with respect to each of the grayscales.

According to yet another aspect of the present disclosure, the calculating of the dimming value for the abnormal block may include calculating a dimming value for the abnormal block with respect to each of the grayscales.

According to still another aspect of the present disclosure, the detecting of the abnormal block may include measuring a brightness of each of the plurality of blocks by scanning the liquid crystal display panel on which the image is displayed.

According to still another aspect of the present disclosure, the detecting of the abnormal block may include detecting a block with a brightness different from a brightness measured from a reference block among the plurality of blocks as an abnormal block.

According to still another aspect of the present disclosure, the calculating of the dimming value for the abnormal block may include calculating a dimming value for the abnormal block using the following Equation.

Dimming value for abnormal block=(Brightness measured from abnormal block/Brightness measured form reference block)*Dimming value for reference block [Equation]

According to still another aspect of the present disclosure, the reference block may be a block at the center of the liquid crystal display panel among the plurality of blocks.

According to still another aspect of the present disclosure, the reference block may be a block with a brightness corresponding to a mode among brightnesses respectively measured from the plurality of blocks.

A liquid crystal display device may include a liquid crystal display panel including a plurality of pixels, a backlight unit including a plurality of light sources, and a local dimming unit that includes a memory in which grayscale dimming values for a plurality of blocks of the liquid crystal panel are stored and drives the backlight unit based on the grayscale dimming values. The memory stores different grayscale dimming values for an abnormal block where a light leakage or a black uniformity defect occurs and a reference block among the plurality of blocks.

According to another aspect of the present disclosure, the local dimming unit may be configured to receive input data for the liquid crystal display panel, set a representative value for each of the plurality of blocks based on the input data, control the backlight unit with respect to each of the plurality of blocks based on a dimming value corresponding to the representative value, calculate gain values for the plurality of pixels based on light profile data of the plurality of light sources, and compensate for the input data based on the gain values.

According to yet another aspect of the present disclosure, the number of the abnormal blocks maybe increased from the center to edges of the liquid crystal display panel.

According to still another aspect of the present disclosure, the liquid crystal display panel may be an in-plane switching (IPS) panel.

According to still another aspect of the present disclosure, the liquid crystal display device further includes a timing controller for controlling a driving of the liquid crystal display panel. The local dimming unit may be included in the timing controller.

According to still another aspect of the present disclosure, if an image with a single grayscale is displayed on the liquid crystal display panel, the same brightness value may be measured from the plurality of blocks.

A method of performing local dimming of a liquid crystal display device may include displaying an image with a single grayscale on a liquid crystal display panel, measuring brightnesses of a plurality of blocks of the liquid crystal display panel, and calculating dimming values for a central block and edge blocks among the plurality of blocks. The calculating of dimming values may include applying different dimming values to the central block and the edge blocks where a light leakage or a black uniformity defect occurs.

According to another aspect of the present disclosure, the applying of different dimming values to the central block and the edge blocks may include independently applying a dimming value to each of the edge blocks.

According to yet another aspect of the present disclosure, the independently applying of the dimming value to each of the edge blocks may include applying a first dimming value to some edge blocks and a second dimming value different from the first dimming value to some other edge blocks.

Although the exemplary embodiments of the present disclosure have been described in detail with reference to the accompanying drawings, the present disclosure is not limited thereto and may be embodied in many different forms without departing from the technical concept of the present disclosure. Therefore, the exemplary embodiments of the present disclosure are provided for illustrative purposes only but not intended to limit the technical concept of the present disclosure. The scope of the technical concept of the present disclosure is not limited thereto. The protective scope of the present disclosure should be construed based on the following claims, and all the technical concepts in the equivalent scope thereof should be construed as falling within the scope of the present disclosure.

What is claimed is:

1. A method of performing local dimming of a liquid crystal display device, the method comprising:

displaying an image with a single grayscale on a liquid crystal display panel;

detecting an abnormal block where a light leakage or a black uniformity (BU) defect occurs among a plurality of blocks of the liquid crystal display panel; and calculating a dimming value for the abnormal block, wherein the calculating of the dimming value for the abnormal block comprises:

receiving input data for the liquid crystal display panel, setting a representative value for each of the plurality of blocks based on the input data, controlling a backlight unit of the liquid crystal display device with respect to each of the plurality of blocks based on a dimming value corresponding to the representative value, calculating gain values for the plurality of pixels based on light profile data of a plurality of light sources included in the backlight unit, and compensating for the input data based on the gain values.

2. The method of performing local dimming of the liquid crystal display device according to claim 1, wherein the displaying of the image includes displaying a plurality of images each having a grayscale from the lowest grayscale to the highest grayscale, and wherein the detecting of the abnormal block includes detecting the abnormal block among the plurality of blocks with respect to each of the grayscales.

3. The method of performing local dimming of the liquid crystal display device according to claim 2, wherein the calculating of the dimming value for the abnormal block includes calculating a dimming value for the abnormal block with respect to each of the grayscales.

4. The method of performing local dimming of the liquid crystal display device according to claim 1, wherein the detecting of the abnormal block includes measuring a brightness of each of the plurality of blocks by scanning the liquid crystal display panel on which the image is displayed.

5. The method of performing local dimming of the liquid crystal display device according to claim 4, wherein the detecting of the abnormal block includes detecting a block with a brightness different from a brightness measured from a reference block among the plurality of blocks as an abnormal block.

6. The method of performing local dimming of the liquid crystal display device according to claim 5, wherein the calculating of the dimming value for the abnormal block includes calculating a dimming value for the abnormal block using the following Equation:

Dimming value for abnormal block=(Brightness measured from abnormal block/Brightness measured from reference block)*Dimming value for reference block [Equation].

7. The method of performing local dimming of the liquid crystal display device according to claim 5, wherein the reference block is a block at the center of the liquid crystal display panel among the plurality of blocks.

8. The method of performing local dimming of the liquid crystal display device according to claim 5, wherein the reference block is a block with a brightness corresponding to a mode among brightnesses respectively measured from the plurality of blocks.

9. A liquid crystal display device comprising:

a liquid crystal display panel including a plurality of pixels;

a backlight unit including a plurality of light sources; and a local dimming unit that includes a memory in which grayscale dimming values for a plurality of blocks of the liquid crystal panel are stored, and drives the backlight unit based on the grayscale dimming values, wherein the memory stores different grayscale dimming values for an abnormal block where a light leakage or a black uniformity defect occurs and for a reference block among the plurality of blocks, and wherein the local dimming unit is configured to:

receive input data for the liquid crystal display panel, set a representative value for each of the plurality of blocks based on the input data, control the backlight unit with respect to each of the plurality of blocks based on a dimming value corresponding to the representative value, calculate gain values for the plurality of pixels based on light profile data of the plurality of light sources, and compensate for the input data based on the gain values.

10. The liquid crystal display device according to claim 9, wherein the liquid crystal display panel is an in-plane switching (IPS) panel.

11. The liquid crystal display device according to claim 9, further comprising:

a timing controller for controlling a driving of the liquid crystal display panel, wherein the local dimming unit is included in the timing controller.

12. The liquid crystal display device according to claim 9, wherein if an image with a single grayscale is displayed on the liquid crystal display panel, the same brightness value is measured from the plurality of blocks.

13. A method of performing local dimming of a liquid crystal display device, the method comprising:

displaying an image with a single grayscale on a liquid crystal display panel;

measuring brightnesses of a plurality of blocks of the liquid crystal display panel; and calculating dimming values for a central block and edge blocks among the plurality of blocks, wherein the calculating of dimming values includes applying different dimming values to the central block and the edge blocks where a light leakage or a black uniformity defect occurs, and wherein the calculating of dimming values further comprising:

receiving input data for the liquid crystal display panel, setting a representative value for each of the plurality of blocks based on the input data, controlling a backlight unit of the liquid crystal display device with respect to each of the plurality of blocks based on a dimming value corresponding to the representative value, calculating gain values for the plurality of pixels based on light profile data of a plurality of light sources included in the backlight unit, and compensating for the input data based on the gain values.

14. The method of performing local dimming of the liquid crystal display device according to claim 13, wherein the applying of different dimming values to the central block and the edge blocks includes independently applying a dimming value to each of the edge blocks.

15. The method of performing local dimming of the liquid crystal display device according to claim 14, wherein the independently applying of the dimming value to each of the edge blocks includes applying a first dimming value to some edge blocks and a second dimming value different from the first dimming value to some other edge blocks.

* * * * *